US006301917B1

(12) United States Patent
Lacoste

(10) Patent No.: US 6,301,917 B1
(45) Date of Patent: Oct. 16, 2001

(54) CONDENSATE BLOWOUT TOOL

(76) Inventor: Marvin Lacoste, P.O. Box 292, Kiln, MS (US) 39556

( * ) Notice: Subject to any disclaimer, the term of this patent is extended or adjusted under 35 U.S.C. 154(b) by 0 days.

(21) Appl. No.: 09/580,093

(22) Filed: May 30, 2000

Related U.S. Application Data

(63) Continuation-in-part of application No. 09/096,206, filed on Jun. 11, 1998.

(51) Int. Cl.[7] ..... F25D 21/14; F16K 11/00; F16K 5/22

(52) U.S. Cl. ..... 62/286; 137/625.47; 137/240

(58) Field of Search ..... 62/272, 289, 291, 62/286, 303; 137/625.47, 240

(56) References Cited

U.S. PATENT DOCUMENTS 3,845,779 * 11/1974 Greene ..... 137/209
4,629,128 * 12/1986 Lawrence ..... 239/526
5,722,458 * 3/1998 Potter ..... 137/625.47
5,964,238 * 10/1999 Junkin ..... 137/15
6,041,611 * 3/2000 Palmer ..... 62/286
6,068,023 * 5/2000 Potter ..... 137/625.47

* cited by examiner

*Primary Examiner*—William Doerrler
(74) *Attorney, Agent, or Firm*—Garvey, Smith, Nehrbass & Doody, LLC

(57) ABSTRACT

An apparatus for placement in a fluid flow line between an evaporator coil of an air conditioning system and a fluid drain line, which includes a body portion formed in the drain line, having a first upper open end portion, and a first and second flow openings; an air flow tube insertable in the first upper open end portion, the tube further comprising a first opening extending outward from the first upper end portion, and a second end portion having a slotted opening in its wall to allow flow through the slotted opening, between the first and second openings, the tube held in position via a shoulder member along its length resting on an end of the first upper end portion; an air source for inserting air through the upper end of the air tube for allowing the air to flow to the first and second openings toward the evaporator coil and the fluid drain line.

2 Claims, 5 Drawing Sheets

CONDENSATE BLOWOUT TOOL

CROSS-REFERENCE TO RELATED APPLICATIONS

This is a continuation in part of U.S. patent application Ser. No. 09/096,206, filed Jun. 11, 1998 by the same inventor. That application is hereby incorporated by reference.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The apparatus of the present invention relates to air conditioner maintenance.

2. General Background of the Invention

Air conditioner condensate piping periodically have tendency to malfunction due to water flow restriction caused mostly by dirt sediment and algae buildup. The preventative maintenance is to keep air filters clean and if accumulation are present, add household Clorox or equivalent to piping. The remedy or procedure, to eliminate the restriction would be to pressure the piping and blow out the matter causing the flow restriction.

To gain access to the internal area of the piping system for repair, it is usually necessary to cut the piping, insert an air hose connected to a pressure content. Then, after clearing the restriction, the piping must be repaired. This procedure takes time, labor and is undesirable.

To incorporate chemical as a preventive means, an access to the inner area of the piping must also be achieved. This usually consists of cutting the existing piping system or installing at original installation a tee fitting with a short nipple riser and a cover (cap). This procedure will then allow chemical maintenance, but will not allow a means to blow down in event of a restrictive inner buildup.

BRIEF SUMMARY OF THE INVENTION

The condensate maintenance mate will allow quick and easy access to perform to both events noted above; i.e., repair and maintenance. What is provided is a device easily installed in a condensate line, of an air conditioning system, a) to allow convenient maintenance by adding a chemical to dissolve algae; b) to allow convenient access for an air pressure source to blow down nuisance restrictive matter that blocks condensate water flow.

The device body (tee section) is in alignment with the main condensate flow. The device has a three way position which allows normal water flow from evaporation to main drain, then air flow in two positions, one position at a time for air pressure directed to evaporator and a second position, air pressure directed to the main drain. To make this functionable, the physical design is as follows: a) A handle is necessary to select the desired function - air - drain - air; b) An access to add chemical or air pressure to system. This is accomplished by partially hollowing the inside of the handle allowing entrance of chemical (for maintenance) and air pressure (for repairs).

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE PREFERRED EMBODIMENT

Figure 1:
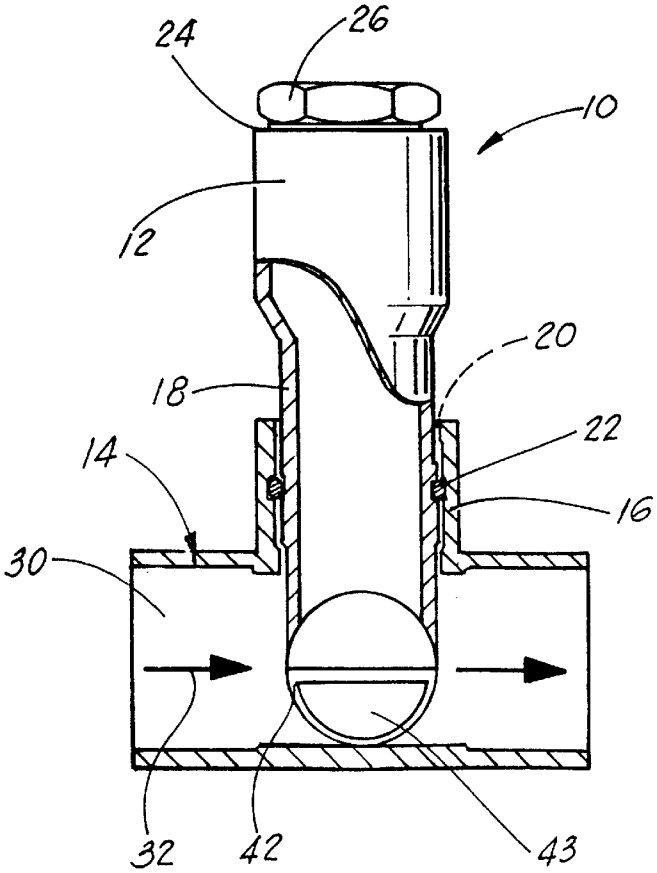
FIG. 1 is an overall sectional view of the preferred embodiment of the apparatus of the present invention.
Figure 2A:
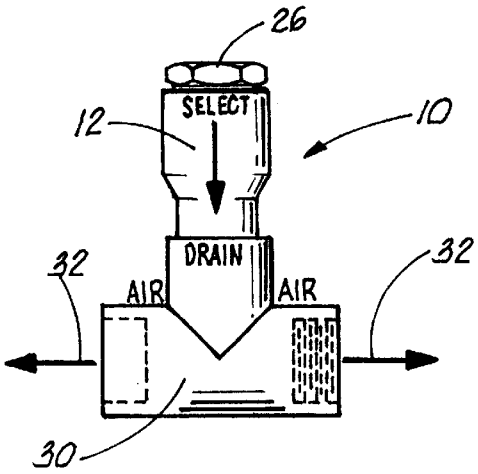
FIGS. 2A and 2B are side views thereof.
Figure 2B:
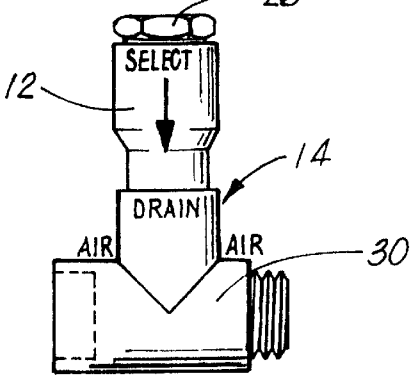

FIGS. 1–6 illustrate the first embodiment of the apparatus of the present invention by the numeral 10, while FIGS. 7A through 9B illustrate an improved version of the present invention. First, as illustrated in FIGS. 1 through 6, condensate mate 10 includes a rotating valve body 12 secured within a T fixture 14. T fixture 14 has an upper position neck portion 16 with the lower body 18 of the rotating valve body 12 inserted into the circular opening 20 in the neck portion 16 of T 14, with an O ring 22 there between for locking the body in place. At the upper end 24 of body 12 would include a removable cap 26 which can be manually set in opening 20 as the case may be. As seen in the figures, the T 14 includes a flow bore 30 where air or fluid flows there through in the direction of arrow 32 when the lower end 18 of body 12 is positioned within the flow bore 30. It may be placed in various positions as needed.

Figure 5:
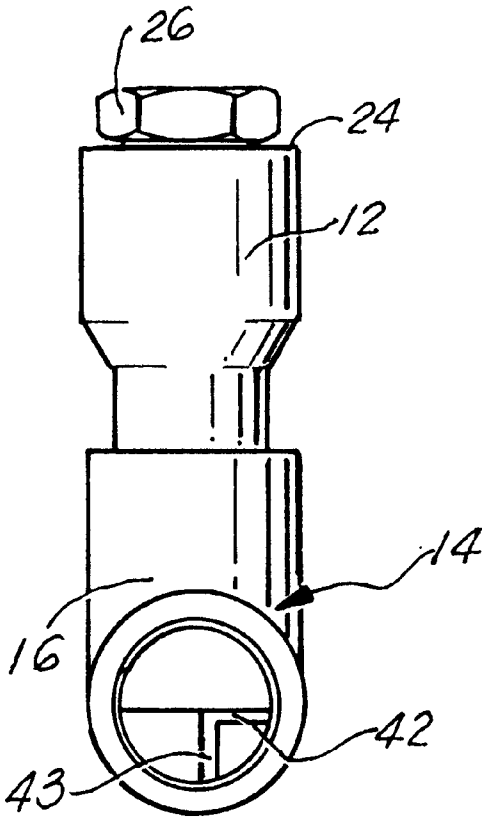
FIG. 5 is a side view of the invention in the "drain" position.
Figure 3:
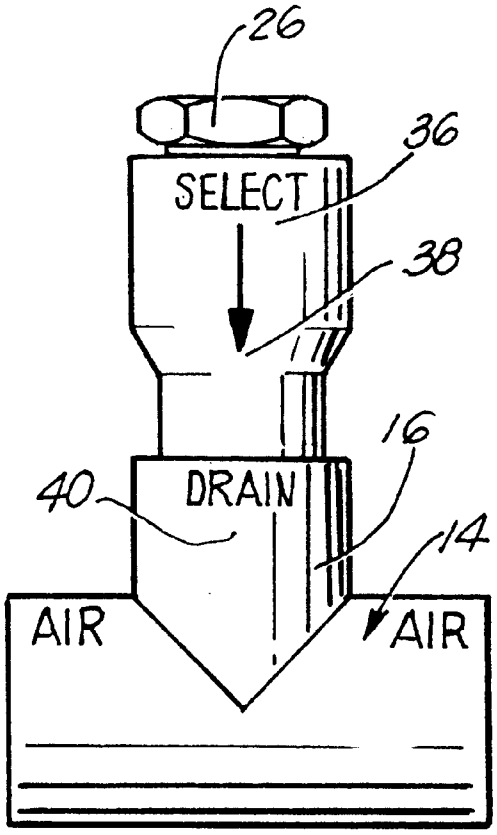
FIG. 3 is a second overall view of the present invention.
Figure 4:
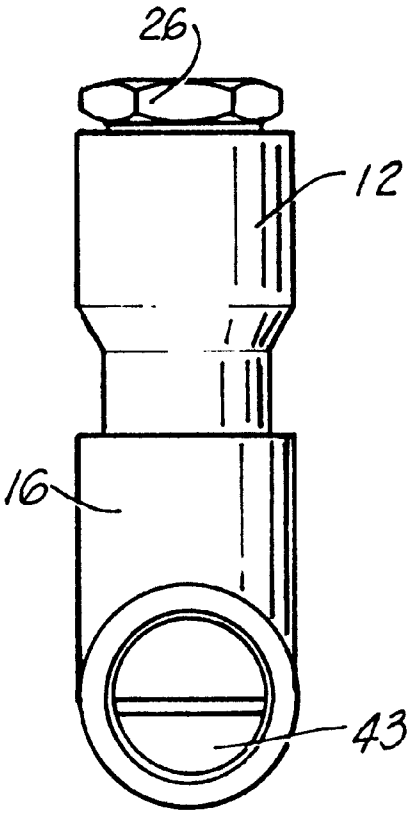
FIG. 4 is a side view of the invention in the "air" position.
Figure 6B:
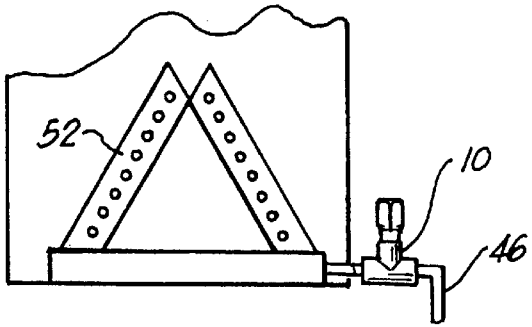
FIGS. 6A and 6B are overall and partial views respectively of the apparatus secured to a heating and cooling system.
Figure 6A:
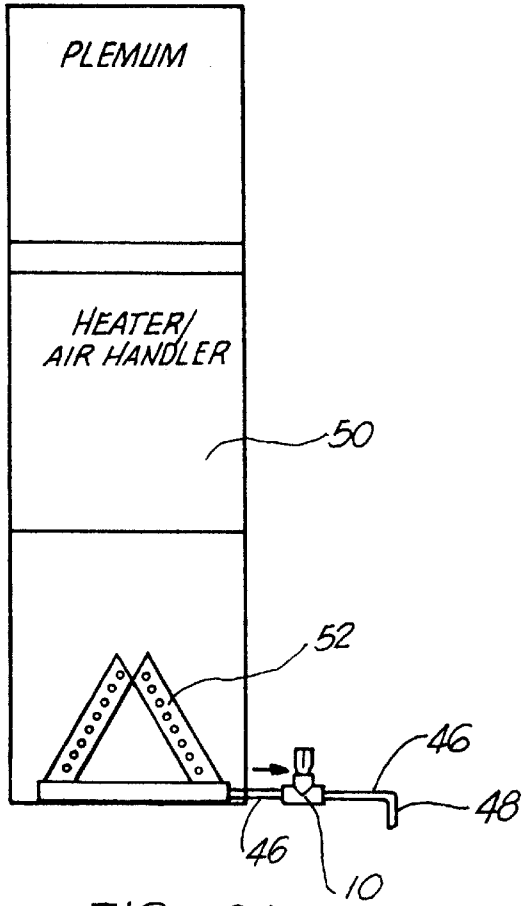
Figure 7B:
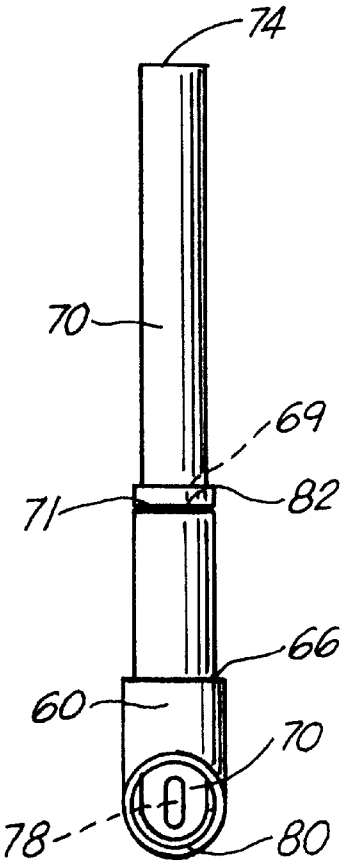
FIGS. 7A and 7B are side and end views respectively of an improved embodiment of the present invention.
Figure 7A:
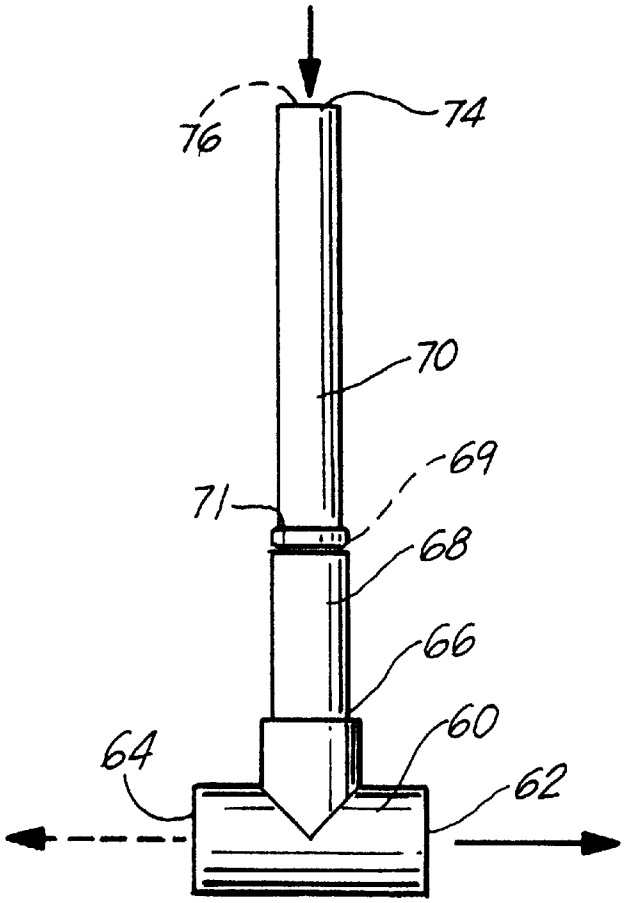

For example, as seen in FIG. 3, the body 12 has the word "select" 36 on its upper portion, and when the arrow 38 has aligned with the word "drain" 40 on the T 14, the body is rotated so that the lower end 18 of the body 12 is in the drain position as seen in FIG. 5. As seen in that Figure, the lower end of the body includes an L shaped member 42, which in the drain position allows fluid to flow from the air conditioning system as seen in FIG. 6A through the drain line 46 into the sewerage drain 48 as indicated. In this position, the fluid which is built up in the system 50, particularly in the evaporating coils 52, drains therefrom. Reference is made now to FIG. 4, where the body 12 has been manually rotated into the "air" position. In this position, the lower vertical foot member 43 of L shaped member 42 has been placed in the position so as to allow air to be forced through the opening in the upper opening 20 when the cap member 26 is removed. In a first position, when the body 12 is rotated, there is air pressure which may be directed from the top portion 24 through opening 20 of the body 12 into the evaporator coil 52 for blowing out any blockages in line 46 as seen in the Figure. When the body is rotated to the second air position, air is then allowed to be blown into the sewerage drain line 46 to break up any blockages in line 46 to the sewerage drain such as algae or the like that may have accumulated. Also in this second air position where air may be blown into the drain line 46, a fluid such as bleach or the like may be poured into the upper portion 24 of body 12 and the bleach would be blocked from flowing into line 46 back to the evaporator coil but would flow through line 46 to the sewerage drain 48 and help to clean out any algae or the like which has accumulated.

Figure 9A:
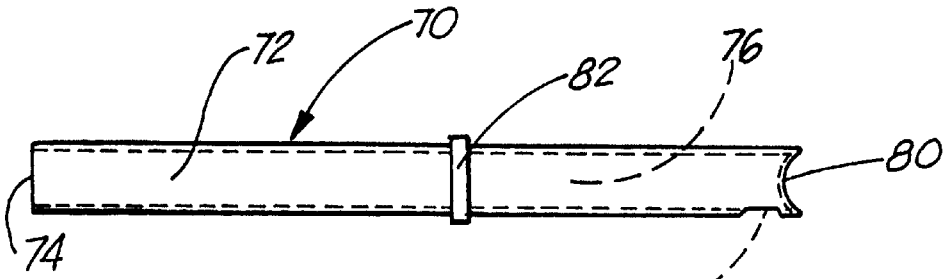
FIGS. 9A and 9B illustrate the air flow tube utilized in the present invention.
Figure 9B:
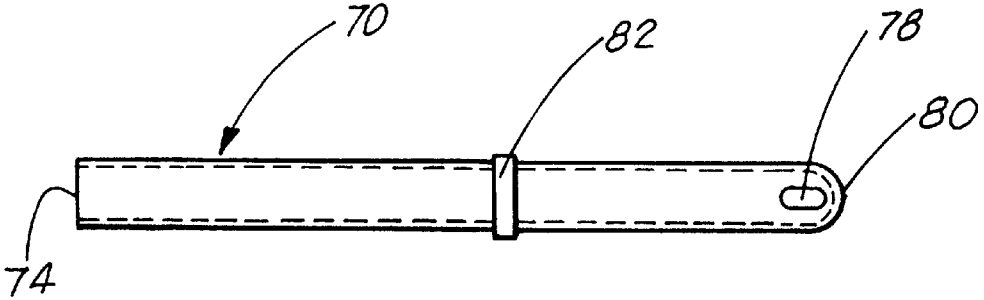

As seen in FIGS. 7A through 9B the improved condensate mate includes a valve body 60 having a first air flow portion 62 allowing air flow to the drain, a second air flow portion 64, allowing air flow to the evaporator unit, and an upright portion 66, having an extended neck portion 68, terminating in an opening 69 for allowing an air tube 70 to be engaged therein. The air tube 70 is more clearly seen in FIGS. 9A and 9B, which illustrates a tube body 72, a first flat end opening 74, an air passageway 76 throughout the tube 70, and a second end slotted opening 78, which is formed in a rounded end 80. The tube body 70 includes a shoulder member 82 around its circumference, as seen in FIGS. 9A and 9B. Returning to FIG. 7A, the air tube 70 has been inserted into opening 69 of portion 68, and the tube 70 is resting on the upper end 71 of portion 68 on shoulder 82. When in this position, slotted air opening 78 is positioned at the air flow passages 62, 64, as seen in FIG. 7B. When in this position, air is allowed to flow through both air ports 62, 64 to its respective destinations, the evaporator and to the drain.

Figure 8:
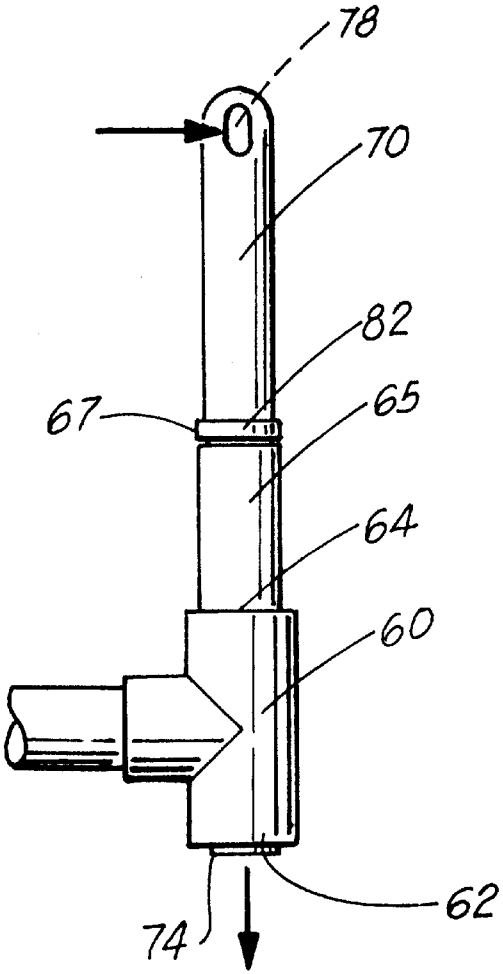
FIG. 8 is a side view of the apparatus in 7A and 7B utilized in a particular manner.

Turning now to FIG. 8, the valve body 60 is positioned on its side with the air flow tube 64 positioned upright, and the air flow tube 62 positioned downward toward the condensate drain. In this position, the air flow tube 64 is accommodating the air tube 70, with the open end 74 of air flow tube 70 positioned within the valve body 60, and the slotted opening 78 positioned facing upright as seen in FIG. 8. As seen, air flow portion 64 includes a member 65 in its opening, which accommodates the air flow tube 70, so that shoulder 82 is resting on the end 67 of member 65. In this position the upper portion of tube 70 is positioned within body 60, and due to its length, it is protruding out of the end 62 of body 60, for allowing air flow to the condensate drain, and not allowing flow to the evaporator. In this configuration air can be forced down tube 70 to clear out the condensate drain, but not flow in to the line to the evaporator. The foregoing embodiments are presented by way of example only; the scope of the present invention is to be limited only by the following claims.

What is claimed is:

1. An apparatus for placement in a fluid flow line between an evaporator coil of an air conditioning system and a fluid drain line, the apparatus comprising:

a) a body portion formed in the drain line, having a first upper open end portion, and a first and second flow openings;

b) an air flow tube insertable in the first upper open end portion, the tube further comprising a first opening extending outward from the first upper end portion, and a second end portion having a slotted opening in its wall to allow flow through the slotted opening, between the first and second openings, the tube held in position via a shoulder member along its length resting on an end of the first upper end portion;

c) means for inserting air through the upper end of the air tube for allowing the air to flow to the first and second openings toward the evaporator coil and the fluid drain line.

2. An apparatus for placement in a fluid flow line between an evaporator coil of an air conditioning system and a fluid drain line, the apparatus comprising:

a) a body portion formed in the drain line, having a first opening for receiving a condensate line from an evaporator;

b) the body portion having a second line for allowing air flow to the condensate drain;

c) the body portion having a third upright line for receiving an air flow tube, the air flow tube insertable in the first upper open end portion, the tube further comprising a first slotted opening in its wall extending outward from the first upper end portion, and a second end portion having an end opening to allow selected flow of air from the slotted opening into the condensate drain for unclogging same, and blocking air flow to the condensate line.

* * * * *